US008182052B2

(12) United States Patent
Bourgain et al.

(10) Patent No.: US 8,182,052 B2
(45) Date of Patent: May 22, 2012

(54) CUPBOARD FORMING A DISPLAY CABINET WITH LOCKING FOR AT LEAST ONE SLIDING PANE

(75) Inventors: Eric Michel Bourgain, Paris (FR); Jean-Jacques Claude Roger Masson, Fontenay Sous Bois (FR)

(73) Assignee: Adler S.A.S., Moussy le Neuf (FR)

( * ) Notice: Subject to any disclaimer, the term of this patent is extended or adjusted under 35 U.S.C. 154(b) by 714 days.

(21) Appl. No.: 12/264,529

(22) Filed: Nov. 4, 2008

(65) Prior Publication Data

US 2009/0151405 A1 Jun. 18, 2009

(30) Foreign Application Priority Data

Nov. 5, 2007 (FR) ..... 07 58777

(51) Int. Cl.
*A47F 3/00* (2006.01)

(52) U.S. Cl. ..... 312/139.2; 312/304; 49/449; 49/425; 49/410

(58) Field of Classification Search ..... 312/139, 312/139.2, 304, 334.24–334.28, 349; 49/449, 49/425, 409, 410; 70/95, 96, 99, 100, DIG. 49; 292/137
See application file for complete search history.

(56) References Cited

U.S. PATENT DOCUMENTS 1,181,331 A * 5/1916 Metzger ..... 312/139.2
1,361,317 A * 12/1920 Dulczewski et al. ..... 292/153
3,401,994 A * 9/1968 Diack ..... 312/139.2
3,460,290 A * 8/1969 Wutzke ..... 49/411
3,490,824 A * 1/1970 Bartlett et al. ..... 312/304
3,855,732 A * 12/1974 Sheaf ..... 49/425
3,917,327 A * 11/1975 Plasko ..... 292/1
4,053,939 A * 10/1977 Nakauchi et al. ..... 361/171
4,098,027 A * 7/1978 Crance ..... 49/504
4,141,610 A * 2/1979 Ando ..... 312/114
4,148,535 A * 4/1979 Fenwick ..... 312/304
4,274,688 A * 6/1981 Zacky ..... 312/304
4,875,349 A * 10/1989 Girard ..... 70/95
4,904,005 A * 2/1990 Frolov ..... 292/251.5
5,853,238 A * 12/1998 Cullen et al. ..... 312/304
6,655,760 B1 * 12/2003 Okazaki et al. ..... 312/116
6,953,903 B2 * 10/2005 Berger et al. ..... 200/61.62
7,503,599 B2 * 3/2009 Ward ..... 292/341.16
(Continued)

FOREIGN PATENT DOCUMENTS

DE 10323696 A1 12/2004
EP 1 640 537 A2 3/2006
FR 2 868 106 A1 3/2004
NR 1 864 438 12/1962

*Primary Examiner* — Darnell Jayne
*Assistant Examiner* — Daniel Rohrhoff
(74) *Attorney, Agent, or Firm* — Kilpatrick Townsend & Stockton LLP

(57) ABSTRACT

A cupboard forming a display cabinet includes at least one pane fixed on a shoe moving along a rail and an electromagnetic lock housed in the frame of the cupboard, so that its bolt can interact with a notch formed on the shoe when the pane is in the locked position. In order to identify the locking of the pane, the rail may have a lateral protrusion and the cupboard may contain an electric circuit including a contact between the bolt of the lock and the protrusion, the closure of the circuit allowing the desired identification.

6 Claims, 2 Drawing Sheets

U.S. PATENT DOCUMENTS 7,775,072 B2 * 8/2010 Pullmann et al. ..... 70/208
2004/0089038 A1 * 5/2004 Iijima ..... 70/257
2009/0151405 A1 * 6/2009 Bourgain et al. ..... 70/78
2011/0266931 A1 * 11/2011 Eric et al. ..... 312/139.2

* cited by examiner

FIG.1
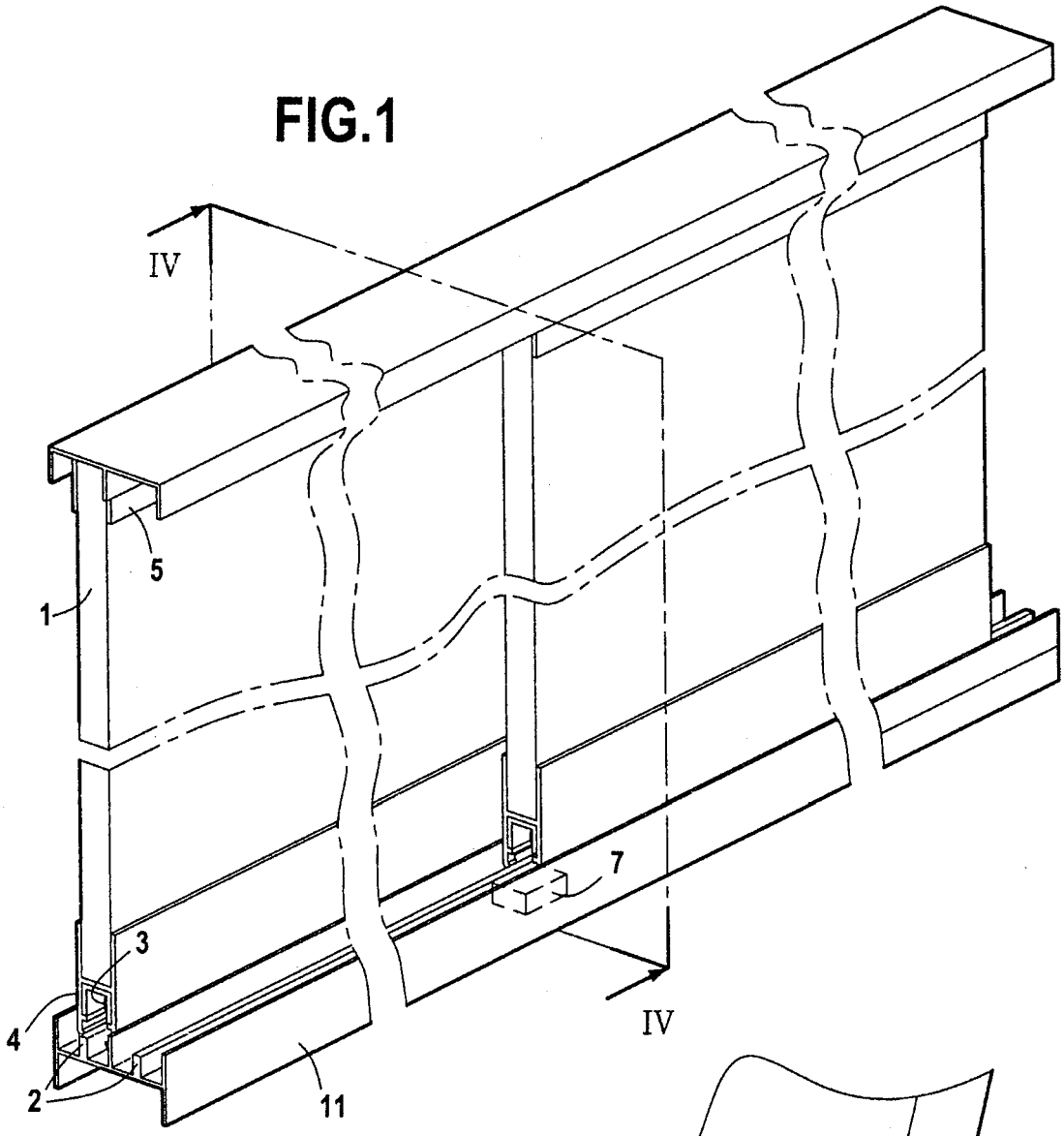
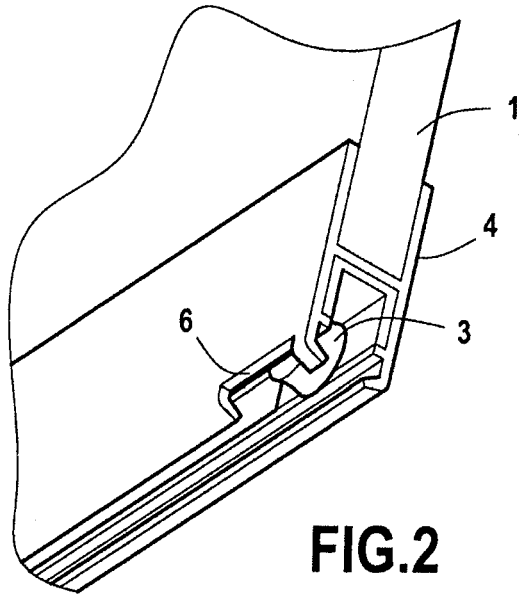
FIG.2

CUPBOARD FORMING A DISPLAY CABINET WITH LOCKING FOR AT LEAST ONE SLIDING PANE

BACKGROUND OF THE INVENTION

The invention relates to a locking system for sliding panes of a cupboard forming a display cabinet. More particularly, the invention relates to a system allowing the locking of a single pane or the simultaneous locking of two sliding panes of a cupboard forming a display cabinet, and the identification of a locked position and the transmission of the corresponding information to a monitoring device.

Manual cupboard-locking systems are already known in the form of conventional mechanical locks. Also known are electromagnetic closure elements which comprise an electromagnet and whose movable element locks the door when the lock is electrically controlled. The advantage of these electromagnetic systems is that they make it possible to verify the locking by defining an electric supervision circuit. Such a system is described for example in patent FR 2 868 106.

The present invention forms an enhancement of this type of closure.

SUMMARY OF THE INVENTION

The object of the invention is both to create a system allowing the locking of at least one sliding pane of a cupboard forming a display cabinet with the aid of a single lock housed in the frame of the cupboard, and to allow the identification of the locking of at least one sliding pane and the transmission to a monitoring device of a corresponding electric signal.

More particularly, the invention relates to a cupboard forming a display cabinet, comprising at least one pane fixed on a shoe moving along a rail, and a lock, wherein the lock is of the electromagnetic type and is housed in the frame of the cupboard so that the bolt of the lock can interact with a notch formed on the shoe when the pane is in the locked position, wherein the rail has at least one lateral protrusion, and wherein the cupboard contains an electric circuit including the contact between the bolt of the lock and said lateral protrusion, the closure of said circuit by said contact allowing the identification of the locking of the pane.

As described above, it is known practice to use electromagnetic closure elements in order to ensure an electric supervision of the locking. The invention proposes to enhance this type of supervision. The cupboard forming a display cabinet according to the invention may therefore advantageously comprise a rail having at least one lateral protrusion and may contain an electric circuit including the contact between the bolt of the lock and said lateral protrusion. The contact between the bolt of the lock and the lateral protrusion closes the electric circuit and therefore allows the identification of the locking of the panes of the cupboard. This electric system has the advantage of being completely independent of the vibrations to which the panes may be subjected. Specifically, the closure contact is made directly between the body of the lock, the rail and the bolt of the lock, so that, all these elements being fixed in the frame of the cupboard, micro-breaks in contact due to the vibrations of the pane are prevented.

Another advantage of this system is that it allows the closure of the electric circuit without the need to add at the end of the shoe an additional part forming a strike, the protrusion of the rail on its own forming a natural stop for the bolt of the lock.

If the cupboard forming a display cabinet comprises two panes, each moving along a rail, the lock is housed between the two rails and can interact with the notch of each shoe when the panes are in the locked position. Advantageously, the lock is housed in the bottom portion of the frame of the cupboard, and in particular, the bolt of the lock may be configured to interact with said notch of the shoe in a movement of vertical displacement.

BRIEF DESCRIPTION OF THE DRAWINGS

The invention will be better understood and other advantages of the latter will better appear in the light of the following description given only as an example and made with reference to the appended drawings in which:

FIG. 1 is a view in perspective of two sliding panes, in the locked position, of a cupboard according to the present invention;

FIG. 2 is a top view in perspective of the assembly of a sliding pane according to the present invention, and the notch allowing it to be locked;

DETAILED DESCRIPTION OF THE INVENTION

Figure 3:
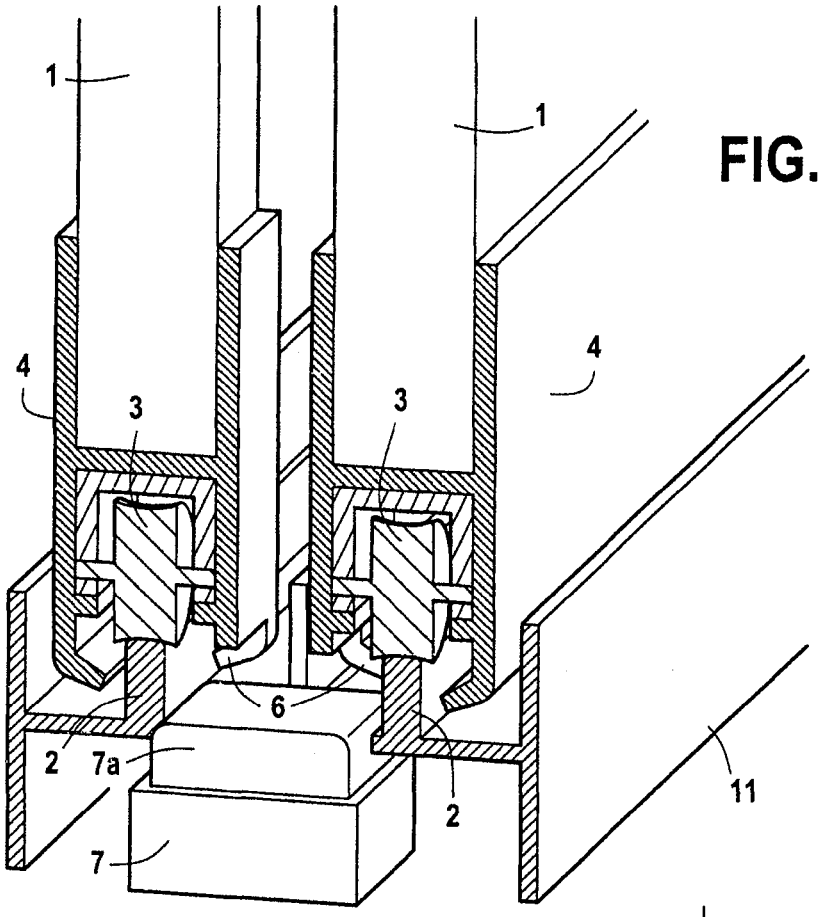
FIG. 3 is a view in partial section along IV-IV of a cupboard with two sliding panes according to the present invention, the panes being in the locked position.

FIG. 1 represents a sliding pane 1 of a cupboard forming a display cabinet that can move along a rail 2. The pane is mounted so as to slide on the rail by means of rollers 3, inserted and shrunk into shoes 4 with an H-shaped profile. In its bottom portion, the pane is mounted in a rebate in said shoe 4, by bonding with silicone or clamping by any suitable means for example. Advantageously, the H-shaped shoes may extend over the whole length of the pane. In its top portion, the pane is simply guided by a U-shaped profile 5. The shoe, shown in greater detail in FIG. 2, has, in its bottom portion, a notch 6 allowing the bolt of a lock housed in the bottom frame 11 of the cupboard to interact with said notch.

FIG. 3 shows two adjacent panes 1 of a cupboard forming a display cabinet, each one fixed to a shoe 4 and mounted so as to slide along a rail 2. Each shoe 4 has a notch 6 in its bottom portion turned toward the adjacent rail. An electromagnetic lock 7 is housed in the bottom frame 11 of the cupboard, between said rails. When the lock is electrically controlled, its bolt 7*a* moves in a substantially vertical movement until it interacts simultaneously with the respective notch 6 of each shoe. Therefore, both panes are immobilized laterally and can no longer slide along the rails.

Figure 4:
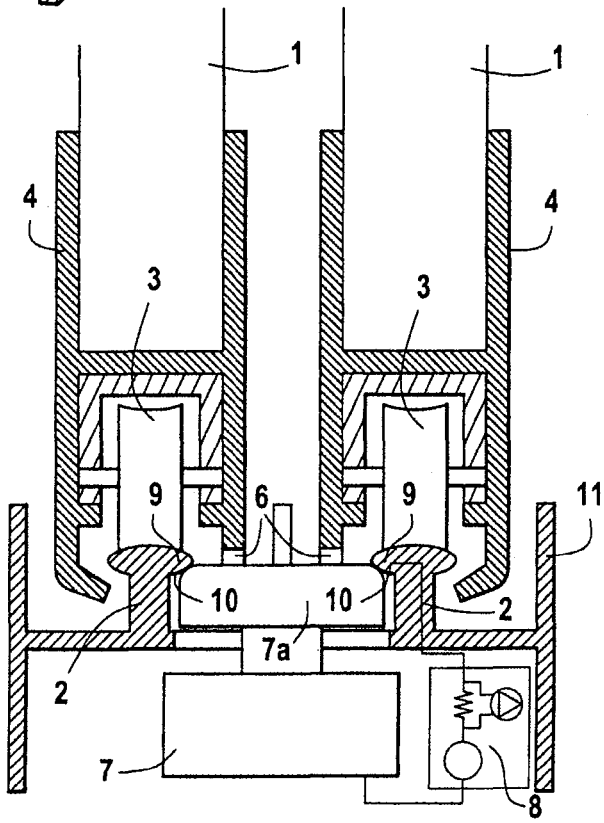
FIG. 4 is a view in partial section of a cupboard with two sliding panes according to the present invention, the electric circuit being closed.

FIG. 4 shows an embodiment of the invention allowing the transmission of an electric signal to a monitoring device when the panes are in the locked position. The cupboard forming a display cabinet contains an electric circuit 8 allowing the identification of the locking of one or more sliding panes. The rail 2 on which a pane 1 of the cupboard slides has at least one lateral protrusion 9 on the side of the lock housed in the frame 11 of the cupboard.

When the door is in the locked position, the protrusion 9 of the rail 2 forms a natural stop for the bolt 7*a* of the lock and the contact between said elements closes the electric circuit 8 allowing the transmission of an electric signal to a monitoring device. In particular, this electric signal may be transmitted to an alarm.

If the cupboard forming a display cabinet comprises two panes, each sliding on a rail, at least one of said rails has a lateral protrusion on the side of the adjacent rail. It is clear that a single contact between the bolt and a protrusion is sufficient to close the electric circuit. If the rails each have a lateral protrusion, the circuit is closed as soon as a contact occurs between the bolt and one of the two protrusions.

Advantageously, the lateral protrusion 9 may be lined by a conductive coating 10 placed in the vicinity of the portion of contact between the rail and the bolt of the lock. This conductive coating makes it possible to increase the reliability over time of the electric contact. This conductive coating may be a lining of copper or of any other conductive coating, for example of nickel applied by any appropriate method, in particular by nickel-plating.

As a variant of these embodiments, the top portion of the pane may also be mounted on a shoe and the lock may be housed in the top frame of the cupboard, said lock then being able to interact with a notch formed in said top shoe.

The invention claimed is:

1. A cupboard forming a display cabinet, comprising:

at least one pane fixed on a shoe moving along a rail;

a lock, comprising a bolt;

a frame;

an electric circuit;

wherein the lock is of the electromagnetic type and is housed in the frame of the cupboard so that the bolt of the lock can interact with a notch formed on the shoe when the pane is in a locked position;

wherein the rail includes at least one lateral protrusion;

wherein the electric circuit is in contact with the bolt of the lock and the at least one lateral protrusion; and wherein contact between the bolt and the lateral protrusion closes the electric circuit and provides an identification that the pane is locked.

2. The cupboard forming a display cabinet as claimed in claim 1, which comprises two panes, each fixed on a shoe moving along a rail, the lock being housed between the two rails and being able to interact simultaneously with a notch formed on each shoe when the panes are in the locked position.

3. The cupboard forming a display cabinet as claimed in claim 1, wherein the at least one lateral protrusion is lined by a conductive coating placed in the vicinity of the portion of contact between the rail and the bolt of the lock.

4. The cupboard forming a display cabinet as claimed in claim 1, wherein the lock is housed in the bottom portion of the frame of the cupboard.

5. The cupboard forming a display cabinet as claimed in claim 1, wherein the bolt of the lock interacts with said notch of the shoe in a movement of vertical displacement.

6. The cupboard of claim 1, wherein the closed electric circuit allows for the transmission of an electric signal to a monitoring device.

* * * * *